United States Patent [19]

Commins et al.

[11] 4,122,640

[45] Oct. 31, 1978

[54] INSULATED TANK JACKETING SYSTEM

[75] Inventors: Alfred D. Commins, Livermore; Frederick T. Kindelvich; Richard C. Schroter, both of Orinda, all of Calif.

[73] Assignee: Kaiser Aluminum & Chemical Corporation, Oakland, Calif.

[21] Appl. No.: 827,643

[22] Filed: Aug. 25, 1977

[51] Int. Cl.[2] ..... B65D 25/16

[52] U.S. Cl. ..... 52/248; 52/249; 52/588

[58] Field of Search ..... 52/248, 249, 489, 588, 52/245, 404, 506; 220/9.2 G, 15

[56] References Cited

U.S. PATENT DOCUMENTS

| | | | |
|---|---|---|---|
| 2,955,686 | 10/1960 | Blomeley et al. | 52/246 |
| 3,339,778 | 9/1967 | Herrenschmidt | 52/404 X |
| 3,555,758 | 1/1971 | Schroter | 52/478 X |
| 4,044,517 | 8/1977 | Schroter | 52/489 X |

*Primary Examiner*—Price C. Faw, Jr.
*Assistant Examiner*—Carl D. Friedman
*Attorney, Agent, or Firm*—Paul E. Calrow; John S. Rhoades

[57] ABSTRACT

A jacketing system for cylindrical storage tank structures of the type used for oil, water, etc., wherein vertically disposed insulated panel sections are affixed to wire cable members or the like on the outside walls of the tank structures and improved articulated fasteners are provided for securing the panel sections to the wire cable members.

13 Claims, 9 Drawing Figures

INSULATED TANK JACKETING SYSTEM

BACKGROUND OF THE INVENTION

The instant system is concerned with the application of insulated panels to storage tank structures. More particularly it is concerned with a system for securing insulated panel sections to storage tanks which constitutes an improvement over the tank jacketing system disclosed and described in Schroter U.S. Pat. No. 4,044,517 issued Aug. 30, 1977. As indicated in the aforesaid Schroter patent, various arrangements or systems have been devised in the past for securing insulated panels of the type shown and discussed in U.S. Pat. Nos. 3,312,028 and 3,555,758 to storage tanks including the systems disclosed in a current brochure of the Owens-Corning Fiberglas Company entitled "Zip-Rib Tank Insulation System" published in June, 1975. While the system proposed in the Schroter patent has been found to be generally satisfactory it still has certain deficiencies as regards the costs of parts used and the time and labor required for installation.

The instant development is concerned with providing a more simplified system for anchoring insulated panel sections to a tank by means of anchoring bands and articulated fasteners. These fasteners are self adjusting under various loads whereby they accommodate themselves in an improved fashion to variations in the dimensions of the tank due to different temperatures and loading conditions while maintaining tight contact with the individual panel sections. Under normal service conditions oil and water storage tanks expand and contract with changes in temperature and hydrostatic pressures resulting from filling and emptying the tanks with liquids, etc., and the larger the tank the greater range of temperature and pressure variation.

Most storage tank exterior panel anchoring band systems, as indicated in prior art U.S. Pat. No. 2,955,686 to Blomeley et al and U.S. Reissue Pat. No. 27,330 to Marcmann, accommodate themselves to the expansion and contraction of the tanks through the use of spring loaded fastener devices. These spring loaded fastener devices are located at spaced intervals about the outside of the tank and as the tank swells or expands from heat or pressure, these fastener devices allow the panel anchoring bands to expand or contract without going slack or becoming over stressed. A drawback of such systems, however, is that the movement of the panel anchoring bands usually takes place at spaced intervals and there is relative horizontal movement and wear of the bands at all other points along the circumference of a tank equipped with such systems. In the panel band anchoring system of the aforementioned Schroter patent the tension bands mounted under the insulated panels generally experience the same thermal change as the tank so that no accommodation for thermal expansion is ordinarily required and there is little or no relative movement of the panel anchoring band elements and the insulation jacket provided by the panels.

There are occasions, however, in exteriorly jacketed storage tank structures, where expansion from the hoop stress in a loaded tank can introduce harmful stresses in the anchor bands which in turn diminish the useful strength of the bands used to secure the jacketing formed from insulated panels to the tank wall. By utilizing stranded wire cables in lieu of solid steel bands or tracks and the instant improved articulated fasteners for securing the panels to the cables during application of a jacketing system to a tank, the tank and wire cables will expand substantially uniformly relative to each other with the result that no undue stresses or movements will be imposed on the jacketing system and the components thereof.

The instant tank jacketing anchoring system also constitutes an improvement over those disclosed in the prior art patents noted in the aforementioned Schroter patent as well as those described in U.S. Pat. Nos. 2,355,947; 2,442,977; 3,339,778; 3,154,889; 3,174,591; 3,562,987; 3,555,758 and 3,572,000.

SUMMARY OF THE INVENTION

Figure 4:
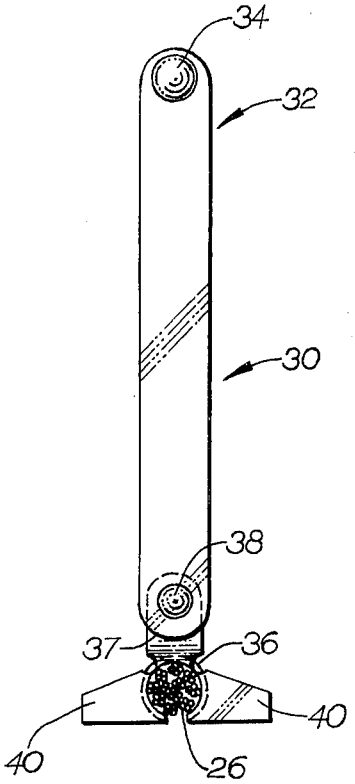
FIG. 4 is a vertical side elevational view of one embodiment of the improved fastener device of the instant invention.
Figure 6:
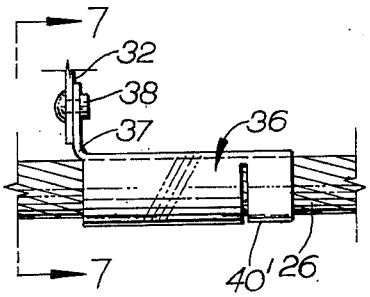
FIG. 6 is a view of a bottom portion of a modified fastener device.
Figure 7:
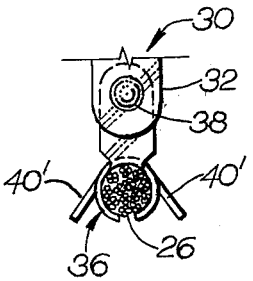
Figure 8:
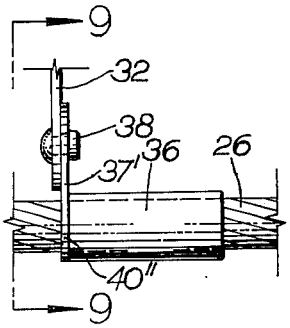
Figure 9:
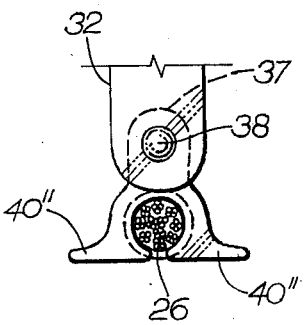

FIG. 7 is a view similar to FIG. 4 of the lower portion of a modified fastener device when taken along the line 7—7 of FIG. 6; and FIGS. 8 and 9 are views similar to those of FIGS. 6 and 7 and disclose a further modified form of fastener device.

DETAILED DESCRIPTION

Figure 1:
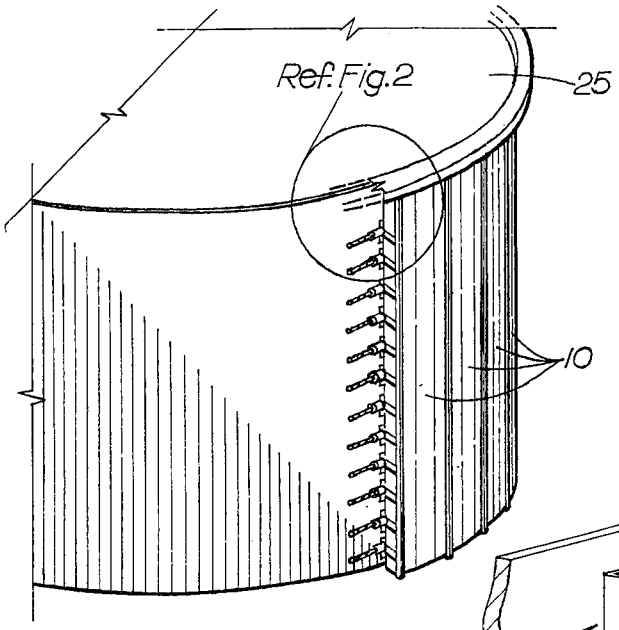
FIG. 1 is a broken and partial perspective view of a conventional cylindrical storage tank structure provided with the improved insulated jacketing system of the instant invention.
Figure 2:
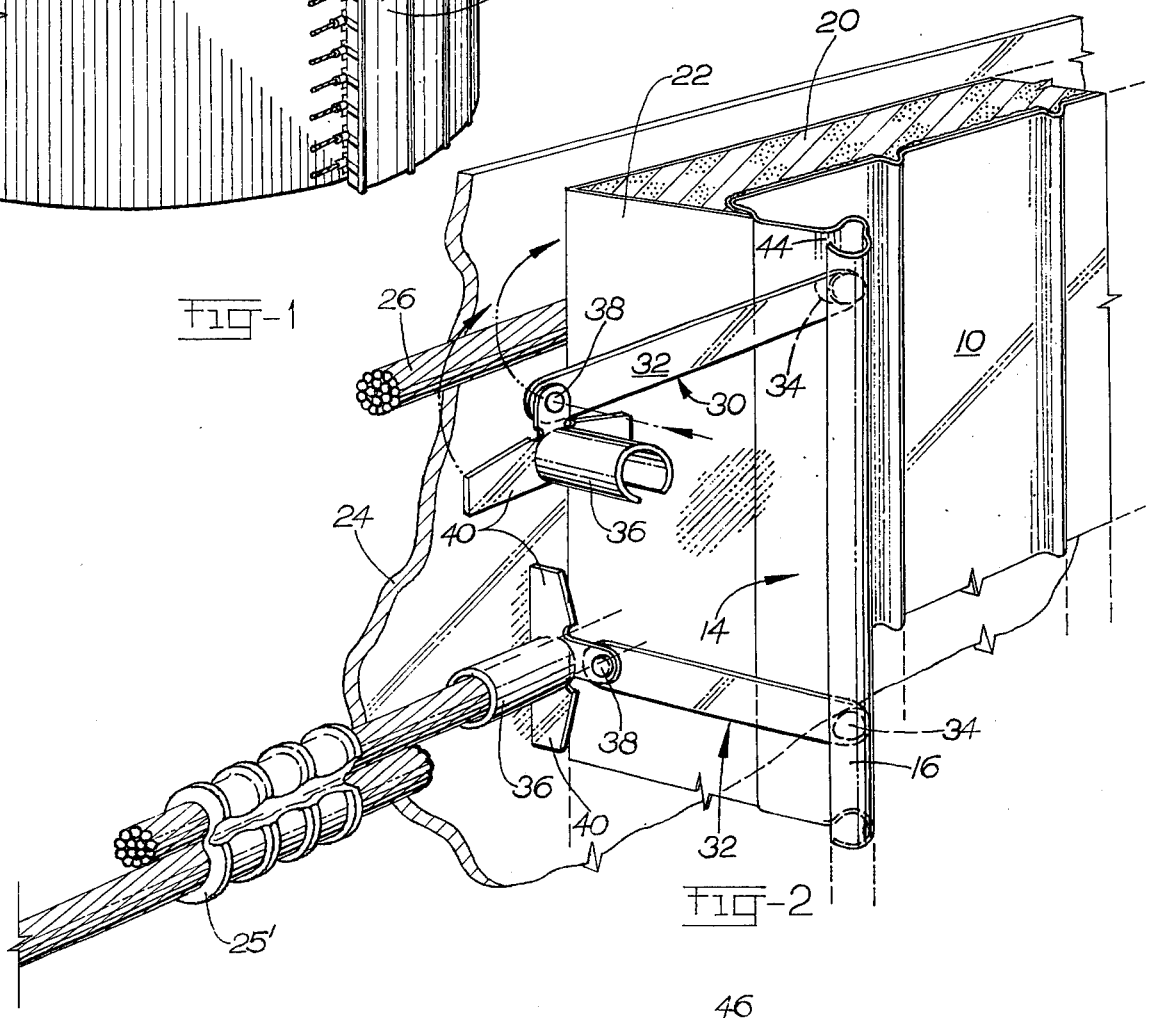
FIG. 2 is a fragmentary perspective view taken within the circumscribing circle 2 of FIG. 1 and discloses the improved articulated fastener devices of the instant invention for securing the insulated panel sections to the cable bands arranged circumferentially about the exterior wall of the tank structure.
Figure 3:
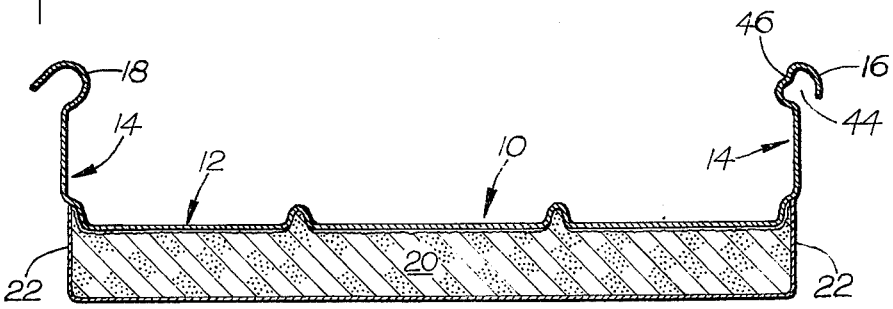
FIG. 3 is a sectional view of a typical panel section which can be anchored to the storage tank wall of FIG. 1 by the fastener devices of the instant invention.

With further reference to the drawings, and in particular FIGS. 1 and 2, a preferred embodiment of the tank jacketing system of the instant invention contemplates using the insulated or composite panels 10 of the type generally shown in U.S. Pat. No. 3,555,758. The panels are joined together generally in the fashion shown in U.S. Pat. No. 3,555,758 as well as in U.S. Pat. No. 3,312,028 whereby they can be anchored to another surface, when insulated, such as a tank wall by fasteners which constitute improvements over those shown in the prior patent of Schroter and U.S. Pat. No. 3,708,943.

A composite panel 10 is generally comprised of a channel shaped, roll-formed metal section 12 that can be ribbed, if desired. The opposing edges of section 12 are provided with upstanding flanges 14. One of these flanges includes a rolled terminal bead 16 while the opposing flange 14 includes a deformable sleeve 18 that is adapted to be folded substantially tightly about the bead 16 on a similarly configured panel 10 when a pair of such panels are disposed in adjoining relationship in the fashion shown in FIG. 5. Panels 10 are advantageously backed with a suitable rigid insulating material layer such as one made of expanded polyurethane foam 20 secured to the underside of the panels. If desired the exposed bottom surface of the insulating layer 20 can be further covered by a vapor barrier medium 22 of thin aluminum foil or another moisture impervious material in the manner shown in U.S. Pat. No. 3,555,758.

When used as the insulated covering for an oil storage tank structure or the like the individual panels 10 can advantageously have a length that approximates the height of the tank to be insulated and they are mounted and assembled together against the cylindrical wall 24 of the tank 25 in the following fashion.

A plurality of metal bands or cables 26 each of which is advantageously made up of a series of twisted steel wires are horizontally disposed in a generally parallel-spaced arrangement on and about the outside surface of the main tank wall 24. The ends of the wire cables 26 can be secured or spliced together and drawn tight against the tank wall 24 in a manner well known in the art such as, by means of the compression splice sleeves 25' of the type sold by the National Telephone Supply Company of Cleveland, Ohio under the trademark "Nicropress" and illustrated in FIG. 2; cable splice connectors sold under the trademark "Electroline" by the Union Metal Manufacturing Company of Canton, Ohio; or cable splice connectors sold by A.B. Chance Company of Centralia, Missouri under the trademark "Superformed."

After the various wire cables 26 are secured in place by means of any of the splice elements as aforesaid which are crimped or affixed to the cable ends by suitable tools the panels 10 are affixed crosswise to the cables in the following fashion by means of the improved articulated fastener devices 30. Each fastener device is generally comprised of a flat blade-type link or body element 32 of a suitable metal such as stainless steel. Link element 32 is fitted at one extremity with a bulbous or somewhat ellipsoidally shaped aluminum rivet or plug element 34 that fits loosely yet snugly in a panel bead 16 and at the opposing extremity with a deformable metallic; e.g., stainless steel clamp or foot 36, which is generally circular or arch-shaped in cross section. Clamp 36 is adapted to be crimped about and anchored to a wire band or cable 26 by a suitable crimping tool in a manner well known in the art, and the longitudinal axis of clamp 36 generally parallels the main axis of bulbous ellipsoidal element 34.

In a preferred embodiment of the invention the deformable clamp 36 is pivotally attached to the blade-type link 32 by an appropriate rivet pin 38. Clamp 36 may also be provided with a pair of anti-rotation wing-like tabs or prongs 40 that can be formed integrally with the clamp 36 and tabs 40 are adapted to rest against the wall 24 of the tank during installation of the articulated fastener device 30 so as to prevent any severe rotation of the clamp about the wire cable 26 even though clamp 36 may be relatively tightly engaged therewith. These anti-rotational tabs may be located closely adjacent the point of pivotal contact between link 32 and a clamp 36 as indicated in FIGS. 4 and 5, 8 and 9 or they may be remotely disposed with respect thereto as indicated by the tabs 40', for example, of FIG. 6 and 7.

Figure 5:
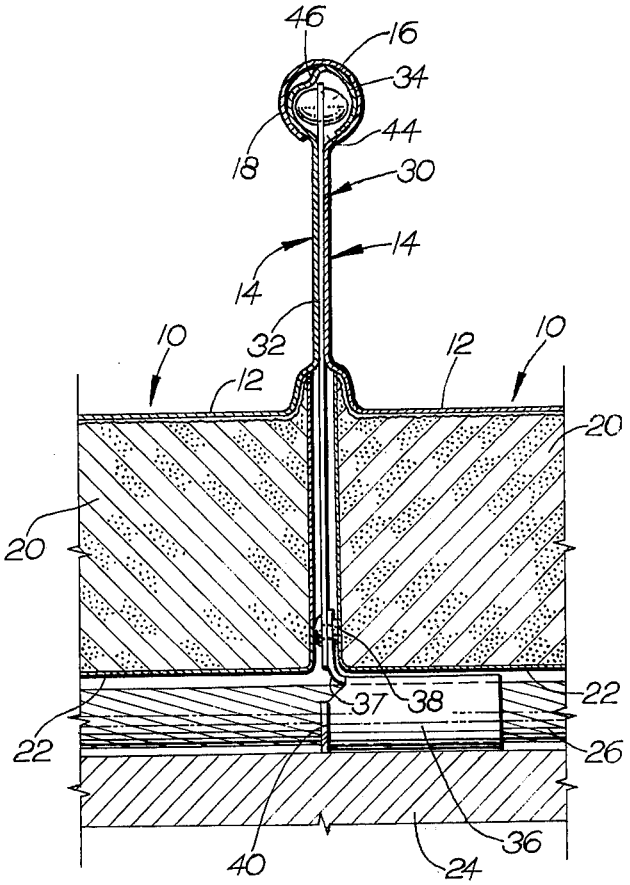
FIG. 5 is an elevational sectional view of the joint between a pair of insulated panels with the fastener device of FIG. 4 being shown in its fully installed position.

In FIGS. 4 and 5 tabs 40 comprise wings in the stamping making up the clamp 36. They are located close to the point of pivotal attachment between clamp 36 and link 32 and project slightly forward of the clamp extension 37 for connecting the clamp 36 to link 32. In the case of the clamp 36 of FIGS. 6 and 7 the tabs 40' are disposed in a remote position relative to the point of pivotal attachment between link 32 and clamp 36. The wings tabs 40'' of FIGS. 8 and 9 advantageously comprise extensions of the main arcuate sidewall 36 of the clamp 36 and they lie in the same plane as and form continuations of the clamp extension 37'. All of the wings or tabs 40, 40' and 40'' are adapted to engage the main wall 24 of the tank and prevent severe and undesirable rotation of a fastener 30 relative to a wire cable 26 as well as a means for holding the cable 26 in spaced relation relative to tank wall 24 and for effecting a somewhat rigid contact between the tank wall 24 and a fastener.

In the installation of the fastener devices and attachment of the panels to the individual wire bands or cables 26, it is contemplated that the rivet element 34 of a fastener 30 would first be inserted within the open mouth 44 of the beaded section 16 of an individual panel element. Thereafter the lower clamp 36 of the fastening element 30 would be rotated into position as noted in FIG. 2 and onto the wire cable 26 where it is finally collapsed and tightly crimped in a place about cable 26 by an appropriate tool. Beaded section 16 can then be slightly crimped or collapsed on opposite sides of the rivet element 34 to prevent slippage, if desired.

This same operation takes place with each of the individual fastening elements 30 disposed along the length of a given panel 10 at the points of juncture between the panel and the transversely disposed individual wire bands or cables 26 until the given panel is anchored in position for its full length against the wall 24 of the tank 25. Thereafter the elongated sleeve 18 of the adjacent panel is advantageously folded about the elongated bead 16 of the first mentioned panel 10 by means of an electric power tool or the like provided with crimping rollers that engage the sleeve 18 of the second panel and progressively fold it over and about the bead 16 of the adjacent and first mentioned panel as the power tool is moved along the tank cover seam formed by the bead 16 of one panel and the sleeve 18 of the adjacent panel. The same tool can be of the self-propelling kind whereby it propels itself along the matching ribs or flanges of the adjacent panels to provide a continuous tight seam between adjacent panels and with a fastening element 30 in turn being locked within the closed ribs in the fashion illustrated in FIG. 5. The tops of the panels 10 fit within and below a tank overhang plate of appropriate design such as that illustrated in the aforementioned patent of Schroter, while the bottoms of the panels can rest upon a block of insulation and a suitable base plate, etc., all again as shown in the aforementioned Schroter application.

If desired, the bead 16 of panel 10 may be so fabricated, as indicated in previously noted U.S. Pat. No. 3,555,758 and the instant application, that it is provided with an anti-siphon groove 46. The overall panel structure or tank covering is relatively continuous with no holes being provided in the exterior surface which not only are unsightly but could provide areas susceptible to leakage and subsequent corrosion of the tank.

By virtue of the aforesaid arrangement the insulated panels 10 can be readily anchored to the wire bands 26. The horizontal spacing between bands depends on the tank size and expected loads. For most tanks the bands will be spaced 6' to 10' apart. The relatively thin blade-type link segments 32 do not become pinched or distorted between the upstanding flanges of the individual panels which at times may bear against each other after installation, seam zipping or during thermal movement. These same link segments on the other hand advantageously maintain a sliding action relative to the adjacent interlocked panels without adverse effects upon link segment or panel. The bulbous rivet element 34 can be advantageously somewhat undersized in overall design relative to the hollow interior of a bead 16 to allow for limited rotational movement within the hollow opening of the bead 16, whereby it is not restricted by varying installation conditions and readily accommodates itself to such conditions. The fastening elements or clips 30 because of their unique articulated structure advantageously tolerate both limited vertical and transverse thermal movement of the panels without becoming disengaged from panel or cable while the particular configuration of the panels helps to absorb transverse thermal movement. The wind loads imposed on the panels during normal use are advantageously resisted by the wire cables 26.

The limited articulated connection that is provided by improved fastening elements 30 also allows for fastener movement both at the joint pin 38 between the clamping foot 36 and at the link section 32 as well as the bulbous rivet element 34, which is somewhat rotatably disposed in the bead 16 of a panel flange and loosely locked to link 32. All of these features permit relative movement of the parts during installation and act in concert to accommodate normal expansion contraction and various other loading conditions on the structure while at the same time avoiding the imposition of severe loads on the fasteners per se which could ultimately lead to their structural failure.

Advantageous embodiments of the invention have been shown and described. It is obvious that various changes may be made therein while remaining within the scope of the appended claims wherein:

What is claimed is:

1. An insulating jacketing system for a storage tank wall and the like comprising a plurality of bands arranged circumferentially on and about the outside surface of the tank wall, means tightly securing a band in place, insulated panels secured crosswise of and and against said bands, said panels comprising channel-shaped sections having upstanding and opposed side flanges, one of which includes a terminal bead and the other of which includes a deformable sleeve that can be folded tightly about the bead on a similarly configured and adjacent channel-shaped section, insulaing material affixed to the underside of each panel section and an articulated fastener securing a pair of panel sections to a band, said fastener comprising a link element interposed between the side flanges of the adjacent panel sections and provided at one extremity with a bulbous rivetlike element insertable within and engageable with the interior wall of the bead of the one panel section about which the sleeve of the adjacent panel section is folded and at the other extremity with a deformable clamp crimped about and engagable with the said band.

2. The system as set forth in claim 1 wherein the clamp is provided with anti-rotational tab means.

3. The system as set forth in claim 2 wherein said tab means comprises opposing wing-like elements projecting from opposite sides of the clamp.

4. An insulating jacketing system for a storage tank wall and the like comprising a plurality of bands arranged circumferentially on and about the outside surface of the tank wall, means tightly securing a band in place, insulated panels secured crosswise of and against said bands, said panels comprising channel-shaped sections having upstanding and opposed side flanges one of which includes a terminal bead, and the other of which includes a deformable sleeve that can be folded tightly about the bead on a similarly configured and adjacent channel-shaped section, insulating material affixed to the underside of each panel section and an articulated fastener securing a pair of adjacent panel sections to a band, said fastener comprising a link element interposed between the side flanges of the adjacent panel sections and provided at one extremity with a bulbous rivet-like element insertable within and engageable with the interior wall of the bead of the one panel section about which the sleeve of the adjacent panel section is folded and at the other extremity with a deformable clamp secured to and engagable with the said band and said clamp being pivotally secured to said link element.

5. An insulating jacketing system for a storage tank wall and the like comprising a plurality of bands arranged circumferentially on and about the outside surface of the tank wall, meas tightly securing a band in place, insulated panels secured crosswise of and against said bands, said panels comprising channel-shaped sections having upstanding and opposed side flanges, one of which includes a terminal bead and the other of which includes a deformable sleeve that can be folded tightly about the bead on a similarly configured and adjacent channel-shaped section, insulating material affixed to the underside of each panel section and an articulated fastener securing a pair of adjacent panel sections to a band, said fastener comprising a link element interposed between the side flanges of adjacent panel sections and provided at one extremity with a bulbous rivet-like element insertable within and engagable with the interior wall of the bead of the one panel section about which the sleeve of the adjacent panel section is folded and at the other extremity with a deformable clamp secured to and engagable with the said band, said clamp being provided with anti-rotational tab means and said tab means being located adjacent the point of connection between the link element and the clamp.

6. An insulating jacketing system for a storage tank wall and the like comprising a plurality of bands arranged circumferentially on and about the outside surface of the tank wall, means tightly securing a band in place, insulated panels secured crosswise of and against said bands, said panels comprising channel-shaped sections having upstanding and opposed side flanges, one of which includes a terminal bead and the other of which includes a deformable sleeve that can be folded tightly about the bead on a similarly configured and adjacent channel-shaped section, insulating material affixed to the underside of each panel section and an articulated fastener securing a pair of adjacent panel sections to a band, said fastener comprising a link element interposed between the side flanges of the adjacent panel sections and provided at one extremity with a bulbous rivet-like element insertable within and engagable with the interior wall of the bead of the one panel section about which the sleeve of the adjacent panel section is folded and at the other extremity with a deformable clamp secured to and engageable with the said band, the said clamp being provided with anti-rotational tab means and said tab means being located remote from the point of connection between the link element and the clamp.

7. A jacketing system for a storage tank wall and the like comprising a plurality of wire band means arranged circumferentially on and about the outside surface of the tank wall, means securing said wire band means to said tank wall, panels secured crosswise of and against said band means, said panels being made in the form of channel-shaped sections having opposed and upstanding side flanges one of which includes a terminal bead and the other of which includes a deformable sleeve that can be folded tightly about the bead on a similarly configured and adjacent panel section and an articulated fastener securing a pair of adjacent panel sections to one of the wire band means, said fastener comprising a flat blade-type link element interposed between the side flanges of the said adjacent panel sections and provided at one extremity with a bulbous head element insertable within and engagable with the hollow interior of the bead of the one panel section about which the sleeve of the adjacent panel section is adapted to be folded and said link element being provided at the other extremity with a deformable clamp crimped about the said one wire band means.

8. The system as set forth in claim 7 wherein the clamp is pivotally affixed to the link element.

9. The system as set forth in claim 7 wherein the clamp is provided with anti-rotational tab means.

10. The system as set forth in claim 9 wherein said tab means comprise opposing wing-like elements projecting from opposite sides of the clamp.

11. The system as set forth in claim 7 wherein a layer of insulating material is affixed to the underside of each panel section.

12. The system as set forth in claim 7 wherein the panels are held in spaced relation to said tank wall by means of said fastener.

13. The system as set forth in claim 7 wherein the band means comprise a stranded wire band.

* * * * *